US006908281B2

(12) United States Patent
Lyons et al.

(10) Patent No.: US 6,908,281 B2
(45) Date of Patent: Jun. 21, 2005

(54) BLOWER HOUSING FOR FURNACE BLOWER ASSEMBLY

(75) Inventors: Leslie A. Lyons, Cassville, MO (US); Harry L. Stephens, Exeter, MO (US)

(73) Assignee: Fasco Industries, Inc., Eaton Rapids, MI (US)

( * ) Notice: Subject to any disclaimer, the term of this patent is extended or adjusted under 35 U.S.C. 154(b) by 28 days.

(21) Appl. No.: 10/623,723

(22) Filed: Jul. 21, 2003

(65) Prior Publication Data

US 2005/0019159 A1 Jan. 27, 2005

(51) Int. Cl.[7] ..... F04D 29/42
(52) U.S. Cl. ..... 415/206; 29/888.024
(58) Field of Search ..... 415/206, 211.2, 415/224, 225; 29/888.024

(56) References Cited

U.S. PATENT DOCUMENTS

| | | | | |
|---|---|---|---|---|
| 2,264,071 A | * | 11/1941 | Vladimirovitch | 415/206 |
| 3,627,442 A | * | 12/1971 | Brandt | 415/206 |
| 5,820,458 A | * | 10/1998 | Lai | 454/354 |
| 6,206,633 B1 | * | 3/2001 | Nakamura et al. | 415/151 |
| 6,314,894 B1 | | 11/2001 | Gatley, Jr. | 110/341 |
| 6,468,034 B1 | | 10/2002 | Garrison et al. | 415/212.1 |
| 6,494,152 B2 | | 12/2002 | Gatley, Jr. | 110/341 |
| 6,595,146 B2 | | 7/2003 | Gatley, Jr. | 110/162 |

FOREIGN PATENT DOCUMENTS

JP 01177499 A * 7/1989 ..... F04D/29/42

* cited by examiner

*Primary Examiner*—Edward K. Look
*Assistant Examiner*—Igor Kershteyn
(74) *Attorney, Agent, or Firm*—Baker & Daniels

(57) ABSTRACT

A blower housing for a furnace blower assembly of the type including a blower motor coupled to an impeller for use in expelling exhaust gases from a furnace. The blower housing generally includes an inlet, an impeller cavity, and an extension portion extending from the impeller cavity, the extension portion terminating in a circular outlet to which a round flue pipe may be attached. The blower housing is formed by three housing members joined to one another, wherein the housing members may be formed from metal using conventional stamping, drawing, and forming processes, for example. To form a variety of different types of blower housings having different outlet offset distances, only the dimensions of cooperating portions of two of the housing members need be varied, with one of the housing members used in common among the different types of blower housings. In this manner, a number of different types of blower housings may be made for furnaces of different designs while reducing tooling, manufacturing, and inventory costs.

23 Claims, 10 Drawing Sheets

BLOWER HOUSING FOR FURNACE BLOWER ASSEMBLY

BACKGROUND OF THE INVENTION

1. Field of the Invention

The present invention relates to blower housings for furnace blower assemblies, the blower housings including an outlet for the attachment of a flue pipe.

2. Description of the Related Art

Blower assemblies are used in modern furnaces to increase the fuel efficiency of the furnace burner by inducing a draft through the furnace to draw heated air and products of combustion through a heat exchanger within the furnace and exhaust same through an exhaust pipe. Typically, the blower assembly includes a blower housing mounted to the furnace, the blower housing defining an impeller cavity therein. The blower housing also includes a mounting surface for mounting a motor to the blower assembly. The motor includes an output shaft to which an impeller is affixed, the impeller disposed within the impeller cavity. In operation, the motor rotatably drives the impeller to draw heated air and exhaust gases from the furnace into the blower housing and to exhaust the heated air and exhaust gases through the outlet of the blower housing into a flue pipe to direct the gases away from the furnace.

Although the addition of a blower assembly has been shown to substantially increase the efficiency of modern furnaces, the blower assembly adds to the overall cost of the furnace and therefore it is desirable to manufacture the blower assembly as economically as possible.

Some known blower housings include four or more individual components which are made of stamped metal, cast metal, or plastic materials. Generally, the more components which are used to form the blower housing, the easier it is to manufacture each of the components, such as by using conventional metal stamping and drawing processes. However, blower housings which include a large number of components have the disadvantage of requiring an increased parts inventory, and also may be somewhat difficult and labor-intensive to assemble.

One known blower housing is formed of two components of stamped/drawn metal which are secured to one another by crimping the edge portions of the pieces to one another. Although this type of construction results in a blower housing which is easy to assemble, the shapes of the two blower housing components requires complicated drawing operations to form the components, making the components somewhat difficult to manufacture and leading to increased tooling costs.

Also, different furnace manufacturers typically have different design requirements for the blower housings, and furthermore, each furnace manufacturer may have different design requirements for different furnaces throughout its product line. For example, the degree of offset, or spacing, of the blower housing outlet from the surface at which the blower housing is mounted to the furnace may vary. Thus, a blower housing which is designed for a particular furnace might not meet the specifications of other furnaces. This requires a manufacturer of blower housings to produce different blower housings of varying specifications in order to suit the needs of each furnace manufacturer.

What is needed is a blower housing for furnace blower assemblies which is an improvement over the foregoing.

SUMMARY OF THE INVENTION

The present invention provides a blower housing for a furnace blower assembly of the type including a blower motor coupled to an impeller for use in expelling exhaust gases from a furnace. The blower housing generally includes an inlet, an impeller cavity, and an extension portion extending from the impeller cavity, the extension portion terminating in a circular outlet to which a round flue pipe may be attached. The blower housing is formed by three housing members joined to one another, wherein the housing members may be formed from metal using conventional stamping, drawing, and forming processes, for example. To form a variety of different types of blower housings having different outlet offset distances, only the dimensions of cooperating portions of two of the housing members need be varied, with one of the housing members used in common among the different types of blower housings. In this manner, a number of different types of blower housings may be made for furnaces of different designs while reducing tooling, manufacturing, and inventory costs.

A first housing member includes a top wall to which a motor may be mounted, and an arcuate wall depending from the top wall. A second housing member includes a planar wall for mounting the blower housing to a furnace, and a first extension wall extending from the planar wall which terminates in a first curved outlet wall. The first and second housing members define the impeller cavity therebetween. A third housing member is attached to the first and second housing members, and includes a second extension wall which cooperates with the first extension wall to define the extension portion of the blower housing, and a second curved outlet wall which cooperates with the first curved outlet wall to define the circular outlet of the blower housing.

Advantageously, the dimensions of the extension walls of the second and third housing members may be modified by a simple retooling of a portion of each of the second and third housing members. Varying the dimensions of the extension walls of the second and third housing members allows for the production of blower housings having a varying degree of offset distance between the planar wall of the second housing member which is attached to the furnace and the edge of the blower housing outlet. The shape of the first housing member need not be varied; rather, the first housing member is a component which is used in common between any number of different types of blower housings. In this manner, different blower housings may be produced in an economically efficient manner.

In one form thereof, the present invention provides a blower housing for a blower assembly of the type used for expelling gases from a furnace, the blower housing including a cavity including an inlet, and an extension portion extending from the cavity and terminating in an outlet, the blower housing formed from at least three separate housing members, including a first housing member; a second housing member attached to the first housing member and cooperating with the first housing member to define the cavity, the second housing member including the inlet and a first extension wall; and a third housing member attached to at least one of the first and second housing members, the third housing member including a second extension wall, the first and second extension walls cooperating to define the extension portion.

In another form thereof, the present invention provides a blower assembly for attachment to a furnace, including a blower housing including an impeller cavity having an inlet, and an extension portion extending from the impeller cavity and terminating in an outlet, the blower housing further including a first housing member; a second housing member attached to the first housing member and cooperating with the first housing member to define the impeller cavity, the second housing member further including the inlet and a first extension wall having a curved end portion; and a third housing member attached to at least one of the first and second housing members, the third housing member including a second extension wall having a curved end portion, the first and second extension walls cooperating to define the extension portion and the curved end portions of the second and third housing members cooperating to define the outlet; a motor attached to the blower housing, the motor including an output shaft extending into the impeller cavity; and an impeller mounted to the motor output shaft and disposed within the impeller cavity, whereby upon rotation of the impeller by the motor, air is drawn into the inlet and is forced through the extension portion and out of the blower housing outlet.

In a further form thereof, the present invention provides a method of assembling blower housings of the type used with a blower motor and impeller for expelling gases from a furnace, the method including the steps of providing a first blower housing member which is common to at least two different types of blower housings; providing at least two second blower housing members of different type; selecting one of the second blower housing members; providing at least two third blower housing members of different type; selecting one of the third blower housing members; attaching the first blower housing member, the selected second blower housing member, and the selected third blower housing member to one another to form a blower housing of a first type.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1:
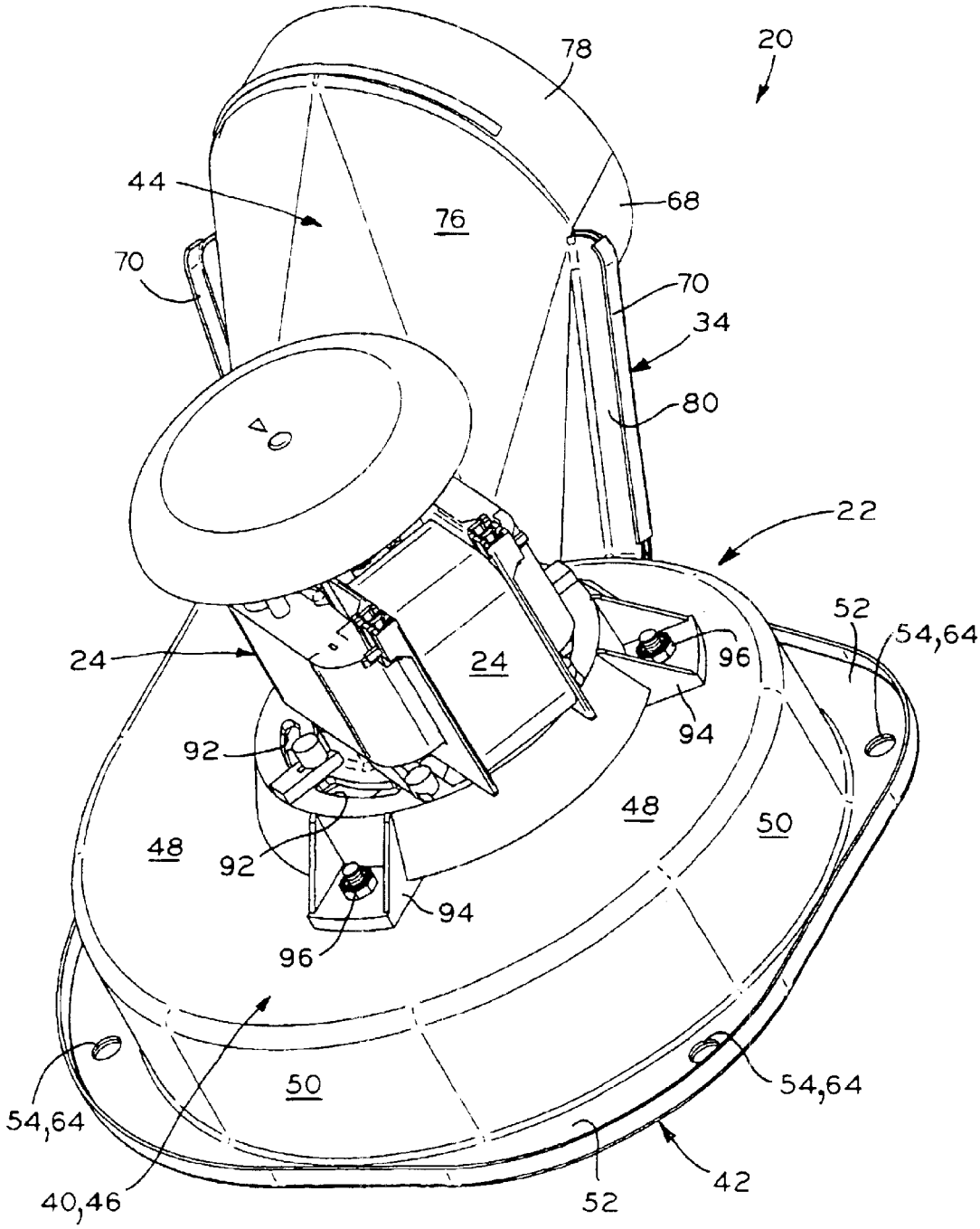
FIG. 1 is a perspective view of a first blower assembly, including a first type of blower housing according to the present invention.

Referring to FIGS. 1–5, blower assembly 20 is shown, which includes a blower housing 22 in accordance with a first embodiment of the present invention. Except as described below, blower assembly 20 includes many features which are similar to the blower assembly disclosed in U.S. Pat. No. 6,468,034, assigned to the assignee of the present invention, the disclosure of which is expressly incorporated herein by reference. Blower assembly 20 generally includes blower housing 22, motor 24 mounted to blower housing 22, and impeller 26 disposed within blower housing 22. Impeller 26 is rotatably driven by motor 24 to draw air from within a furnace (not shown) to which blower assembly 20 is attached through inlet 28 of blower housing 22 and out through outlet 30 of blower housing 22.

Blower housing 22 generally includes inlet 28, impeller cavity 32 in which impeller 26 is disposed, extension or transition portion 34 extending from impeller cavity 32, and outlet 30 at the end of extension portion 34 for attachment of a flue pipe (not shown) to blower housing 22. Blower housing 22 is formed from three housing members, including first housing member 40, second housing member 42, and third housing member 44. Each of the first, second and third housing members 40, 42, and 44 is preferably formed from metal by conventional stamping, drawing, and forming operations, but may optionally be formed from cast metals or plastic materials, for example.

First housing member 40 includes body portion 46 defined by top wall 48 and circular wall 50. Attachment flange 52 extends outwardly from a substantial portion of the periphery of circular wall 50, and includes a plurality of apertures 54 therein. First housing member 40 additionally includes three walls 56*a,* 56*b,* and 56*c* (FIG. 5) which cooperate with second housing member 42 to define impeller cavity outlet 58, as described below.

Second housing member 42 generally includes planar bottom wall 60, which serves as a mounting surface for mounting blower assembly 20 to a furnace, as described further below. Wall 60 includes blower housing inlet 28 therein, which is shown herein as a circular inlet. Optionally, the shape of inlet 28 may vary. Wall 60 also includes lip 62 extending around a substantial portion of the periphery thereof. A plurality of apertures 64 are defined in wall 60 around its periphery. Extension wall 66 extends from wall 60 and terminates in a curved, half-cylindrical outlet wall 68, and further includes mounting flanges 70 on its opposite sides.

Third housing member 44 includes a series of three walls 72*a,* 72*b,* and 72*c* (FIG. 5) for attachment to walls 56*a,* 56*b,* and 56*c* of first housing member 40, as described below. Third housing member 44 additionally includes extension wall 76 terminating in a curved half-cylindrical outlet wall 78. A pair of mounting flanges 80 extend from the opposite sides of extension wall 76.

Generally, first, second, and third housing members 40, 42, and 44 may be attached to one another by any suitable method, such as by crimping, gluing, stapling, welding, riveting, screwing, bolting, snap fit, or by any combination of the foregoing. Preferably, however, first housing member 40 is attached to second housing member 42 by placing the attachment flange 52 of first housing member 40 into abutment with wall 60 of second housing member 42 within the periphery of lip 62, such that apertures 54 in attachment flange 52 of first housing member 40 are aligned with apertures 64 in wall 60 of second housing member 42. Thereafter, lip 62 of second housing member 42 is crimped over the edge of attachment flange 52 of first housing member 40. The foregoing crimped attachment between first and second housing members 40 and 42 provides a secure connection therebetween which resists rattling during operation of blower assembly 20.

Third housing member 44 is attached to first and second housing members 40 and 42 by positioning walls 72*a,* 72*b,* and 72*c* of third housing member 44 over walls 56*a,* 56*b,* and 56*c* of first housing member 40 and attaching same together by welding or by suitable fasteners, for example. Concurrently, mounting flanges 80 of third housing member 44 engage the opposite sides of extension wall 66 of second housing member 42, and mounting flanges 70 of second housing member 42 are thereafter crimped over the edges of mounting flanges 80 of third housing member 44 to securely attach third housing member 44 to second housing member 42.

Extension walls 66 and 76 of second and third housing members 42 and 44, respectively, cooperate to define extension or transition portion 34 of blower housing 22. Additionally, outlet walls 68 and 78 of second and third housing members 42 and 44, respectively, cooperate to define outlet 30 of blower housing 22. Outlet 30 is circular in shape, with a cylindrical profile for attachment of a round exhaust flue (not shown) to outlet 30 using suitable clamps, screws, or other fasteners (not shown), for example. Although outlet walls 68 and 78 each have a half cylindrical profile, the shapes of outlet walls 68 and 78 may be modified whereby one of outlet wall 68 or 78 defines a greater portion of the cylindrical profile of outlet 30 than the other of outlet walls 68 or 78.

Figure 4:
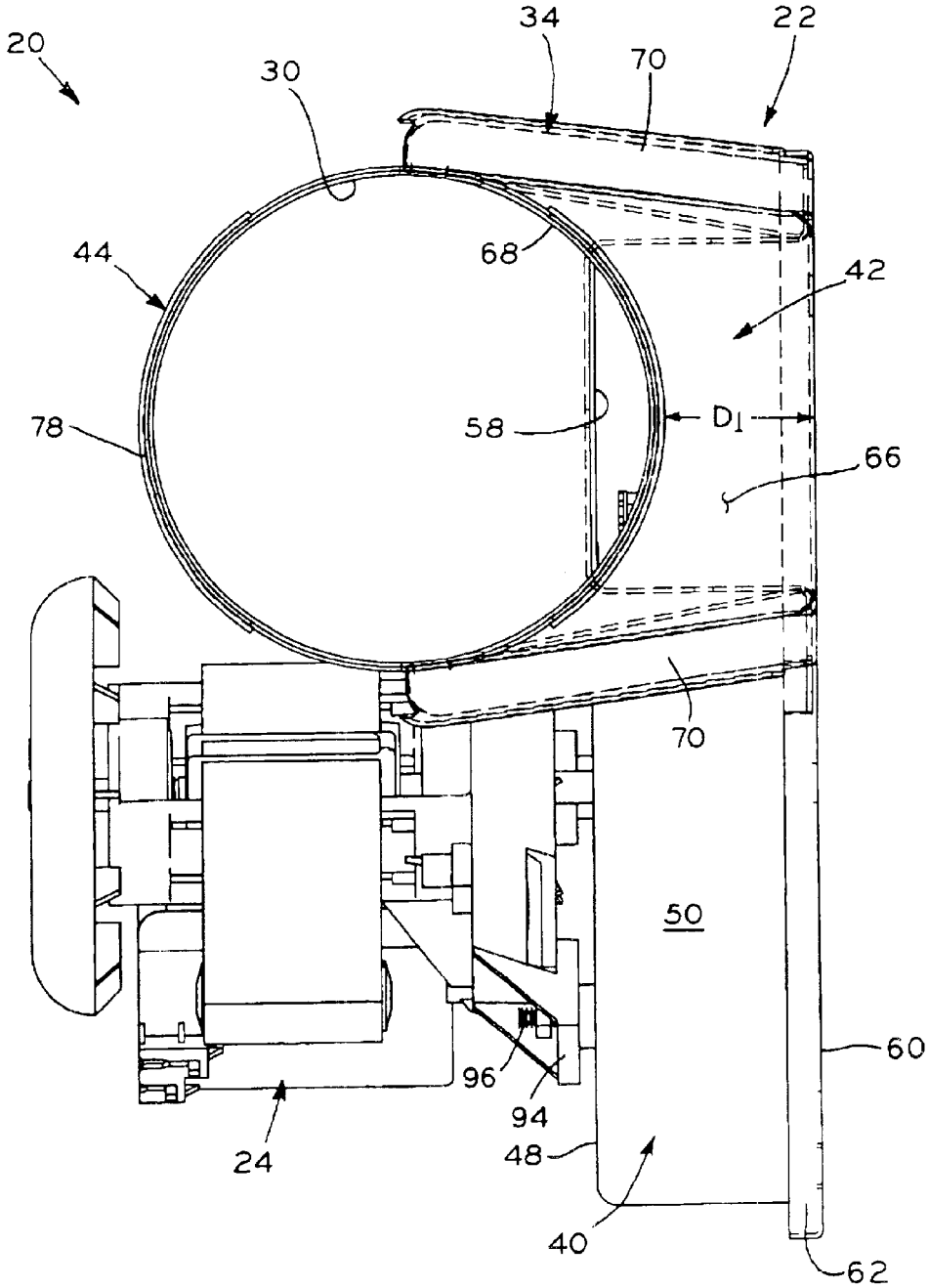
FIG. 4 is a front view of the blower assembly.
Figure 5:
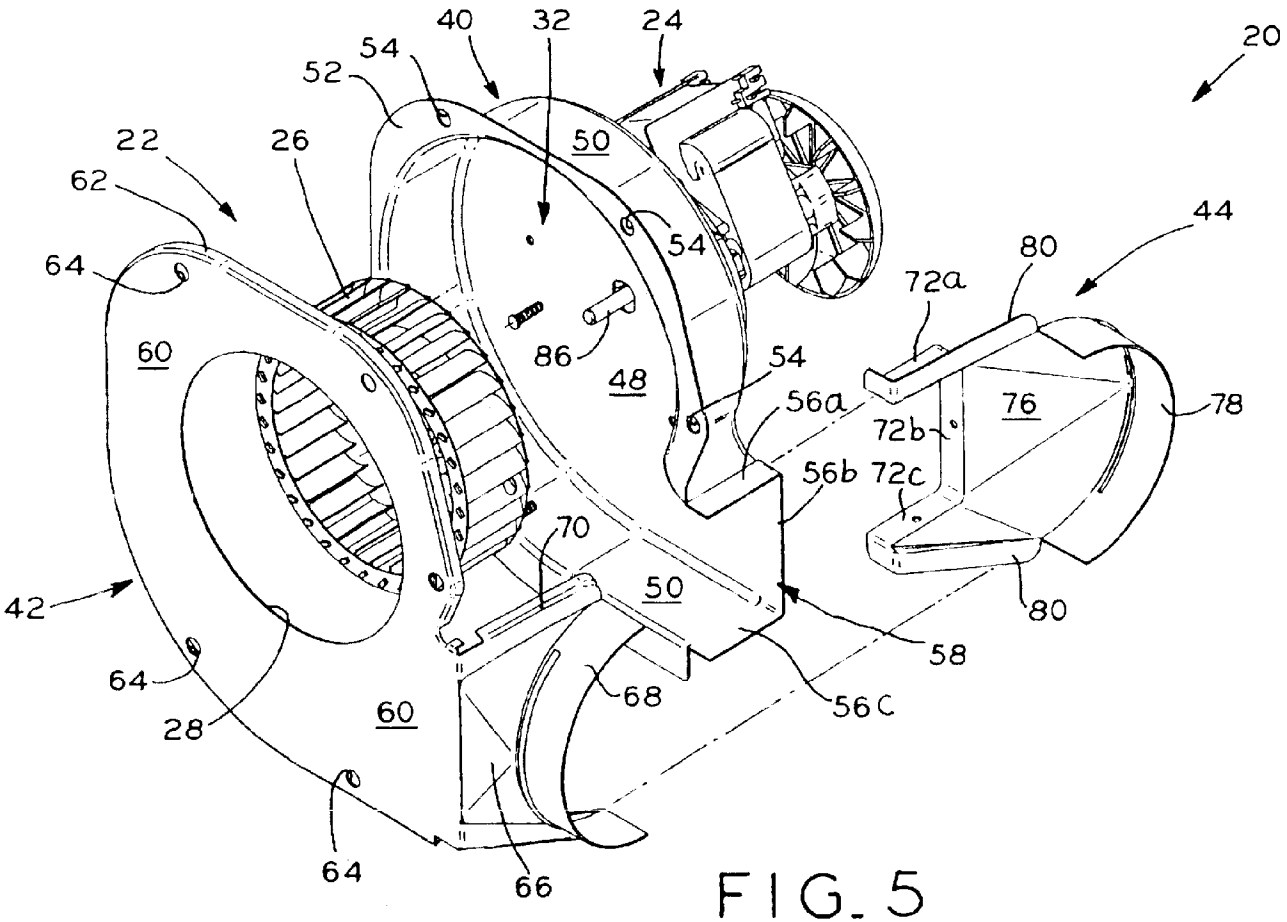
FIG. 5 is an exploded view of the blower assembly.
Figure 6:
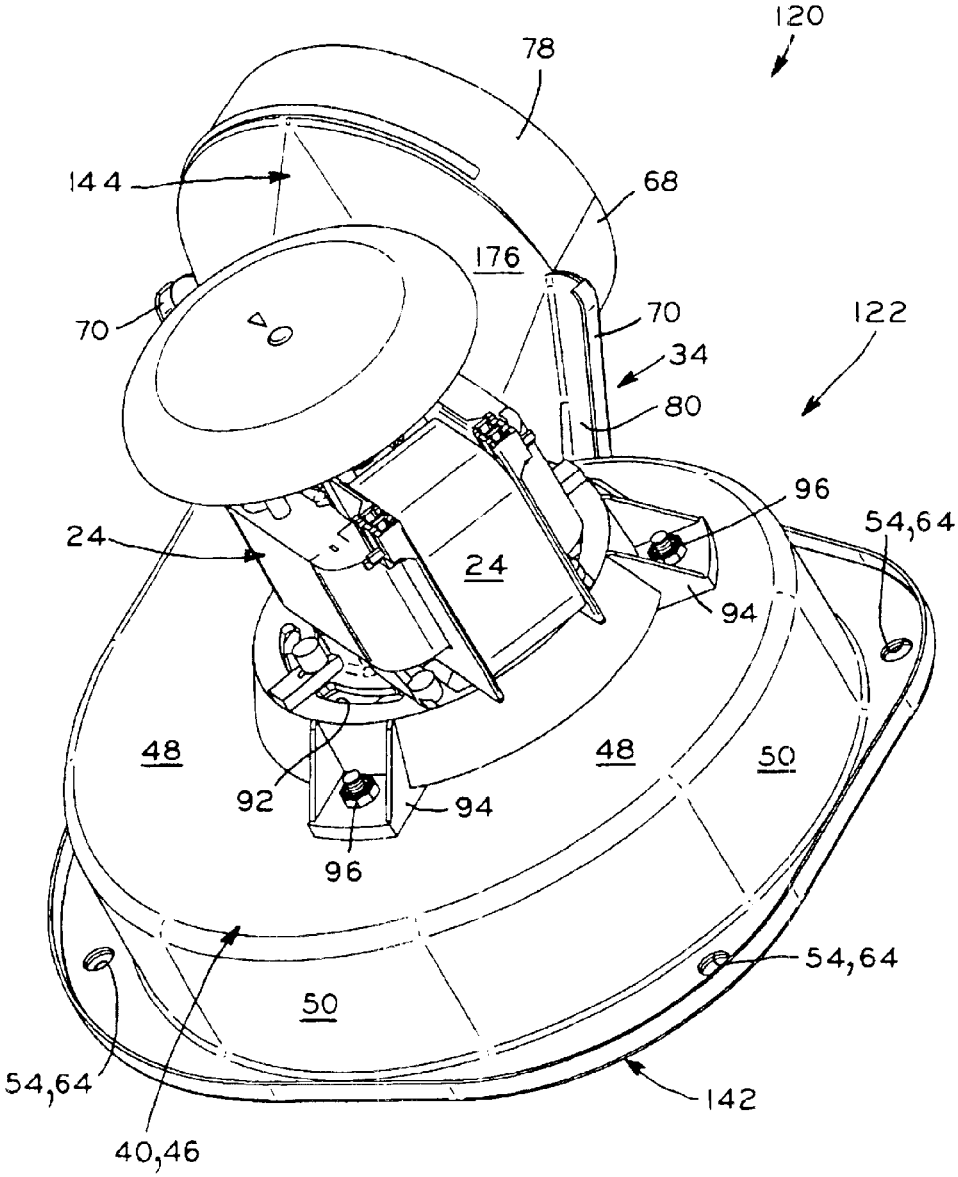
FIG. 6 is a perspective view of a second blower assembly, including a second type of blower housing according to the present invention.
Figure 7:
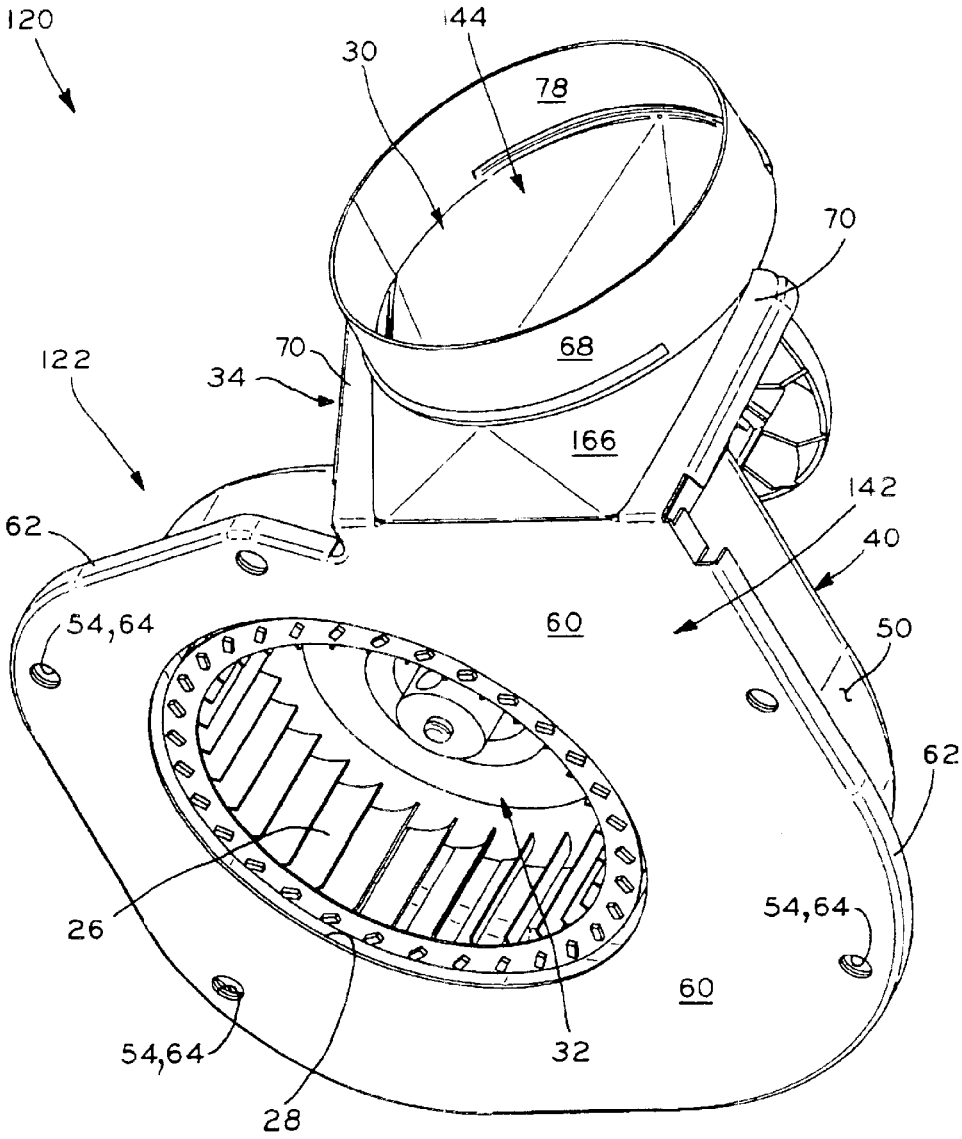
FIG. 7 is another perspective view of the blower assembly.

As shown in FIGS. 4 and 5, it may be seen that walls 56*a,* 56*b,* and 56*c* of first housing member 40 cooperate with wall 60 of second housing member 42 to define impeller cavity outlet 58, which has a rectangular profile. In this manner, extension or transition portion 34 of blower housing 22 defines a transition between the rectangular impeller cavity outlet 58 and the circular blower housing outlet 30.

Figure 2:
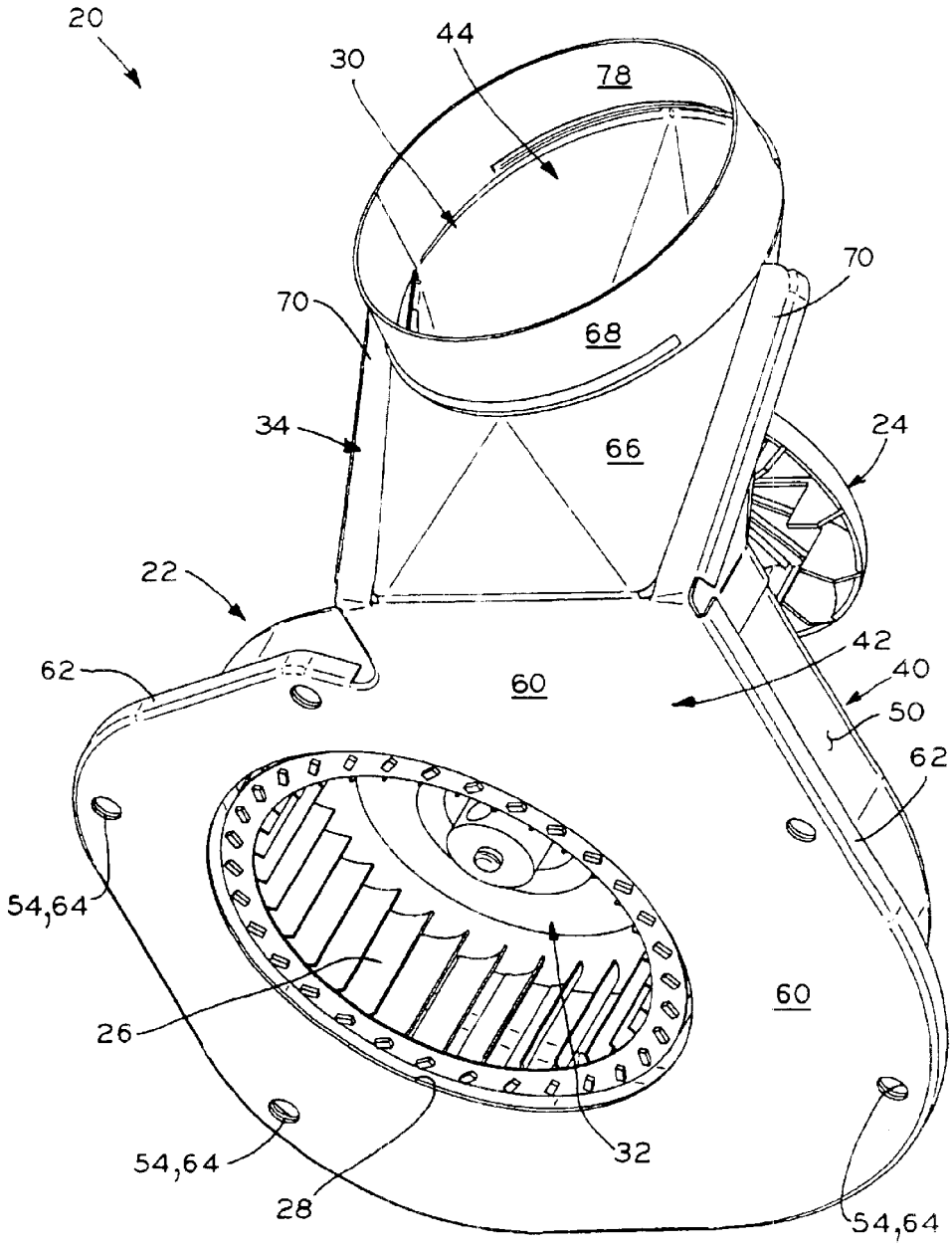
FIG. 2 is another perspective view of the blower assembly.
Figure 3:
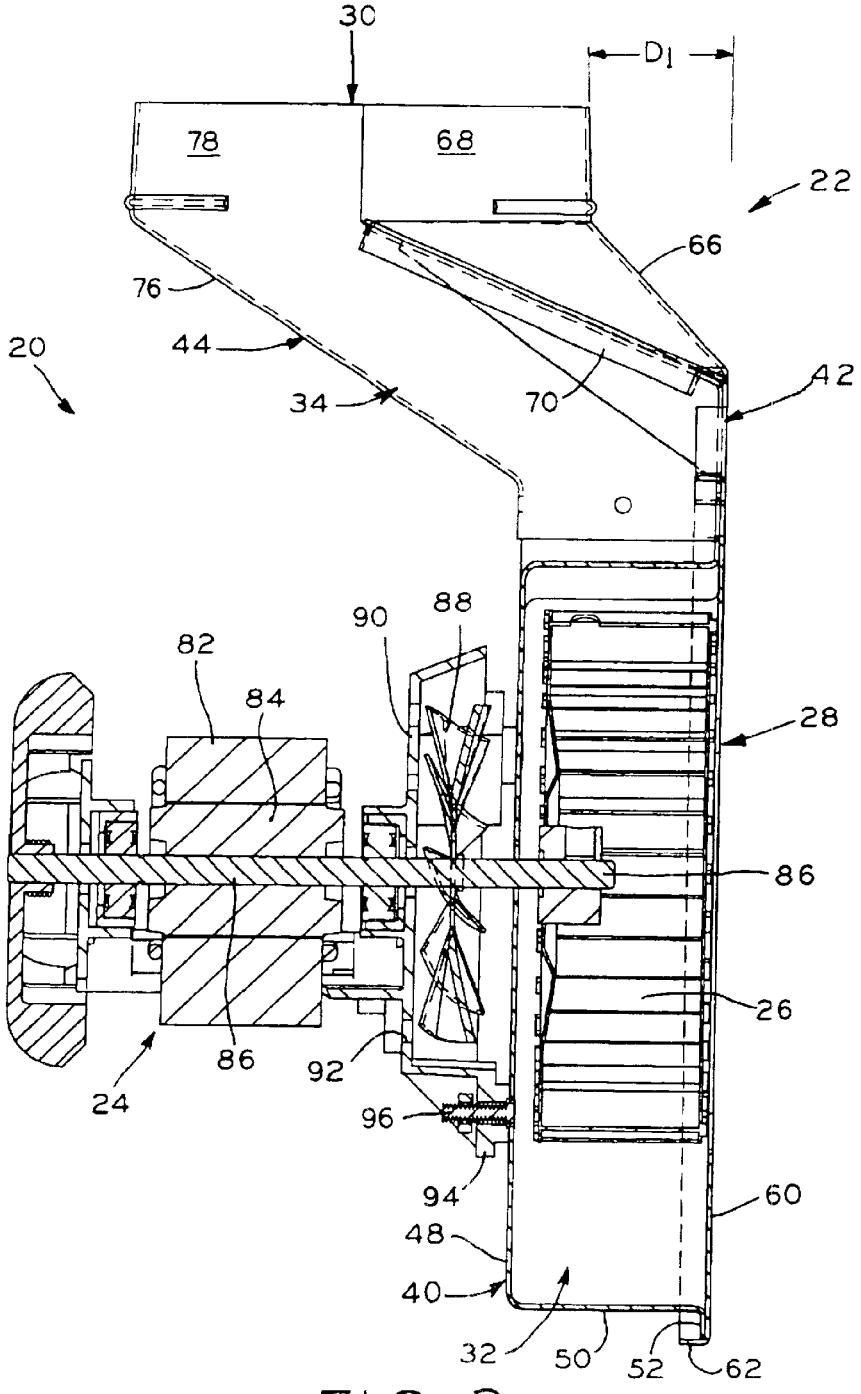
FIG. 3 is a sectional view through the blower assembly.

Referring to FIGS. 1 and 3, motor 24 includes stator 82 and rotor 84 to which output shaft 86 is attached. Impeller 26 is secured to the end of output shaft 86, and is disposed within impeller cavity 38 in alignment with inlet 28 of second housing member 42 of blower housing 22, as shown in FIGS. 2 and 5. Motor 24 additionally includes fan 88 attached to output shaft 86 intermediate rotor 84 and impeller 26. Fan 88 is disposed within fan housing 90 and, during operation of motor 24, fan 88 draws cooling air from between fan housing 90 and top wall 48 of blower housing 22 and blows the cooling air outwardly of fan housing 90 through a plurality of vents 92 (FIG. 1) and over motor 24 to cool motor 24. Motor 24 includes a plurality of feet 94 for attachment to top wall 48 of blower housing 22 using fasteners 96, shown herein as nuts and bolts.

Blower assembly 20 may be mounted to a furnace using suitable fasteners (not shown) which are inserted through the aligned apertures 54 and 64 in first and second housing members 40 and 42, respectively, of blower housing 22, and into engagement with suitable mounting structure of the furnace. In operation, motor 24 rotatably drives impeller 26 with impeller cavity 38 to draw air from the furnace into impeller cavity 38. Thereafter, the air is forced by impeller 26 through impeller cavity outlet 58 and extension portion 34 to exit blower housing 22 through blower housing outlet 30 into a flue pipe.

Referring to FIGS. 3 and 4, it may be seen that extension walls 66 and 76 of second and third housing members 42 and 44, respectively, are dimensioned to provide a first offset distance $D_1$ between wall 60 of second housing member 42 and the corresponding surface of the furnace to which blower housing 22 is mounted and the edge of blower housing outlet 30. The foregoing offset distance $D_1$ provides a clearance space between the furnace and blower housing outlet 30 to facilitate attachment of a flue pipe to blower housing outlet 30. Notably, the offset distance $D_1$ may vary according to the specifications of different furnaces.

In FIGS. 6–9, a second blower assembly 120, including a second blower housing 122 according to the present invention, is shown. Blower assembly 120 is substantially identical to blower assembly 20 of FIGS. 1–5, and identical reference numerals have been used to designate identical features therebetween. However, blower housing 122 of blower assembly 120 includes second housing member 142 having an extension wall 166 which is shorter or smaller than extension wall 66 of second blower housing member 42 of blower housing 22. Similarly, Blower housing 122 of blower assembly 120 includes third housing member 144 having an extension wall 176 which is shorter or smaller than extension wall 76 of third blower housing member 44 of blower housing 22. Otherwise, blower housings 22 and 122 are substantially identical.

Figure 8:
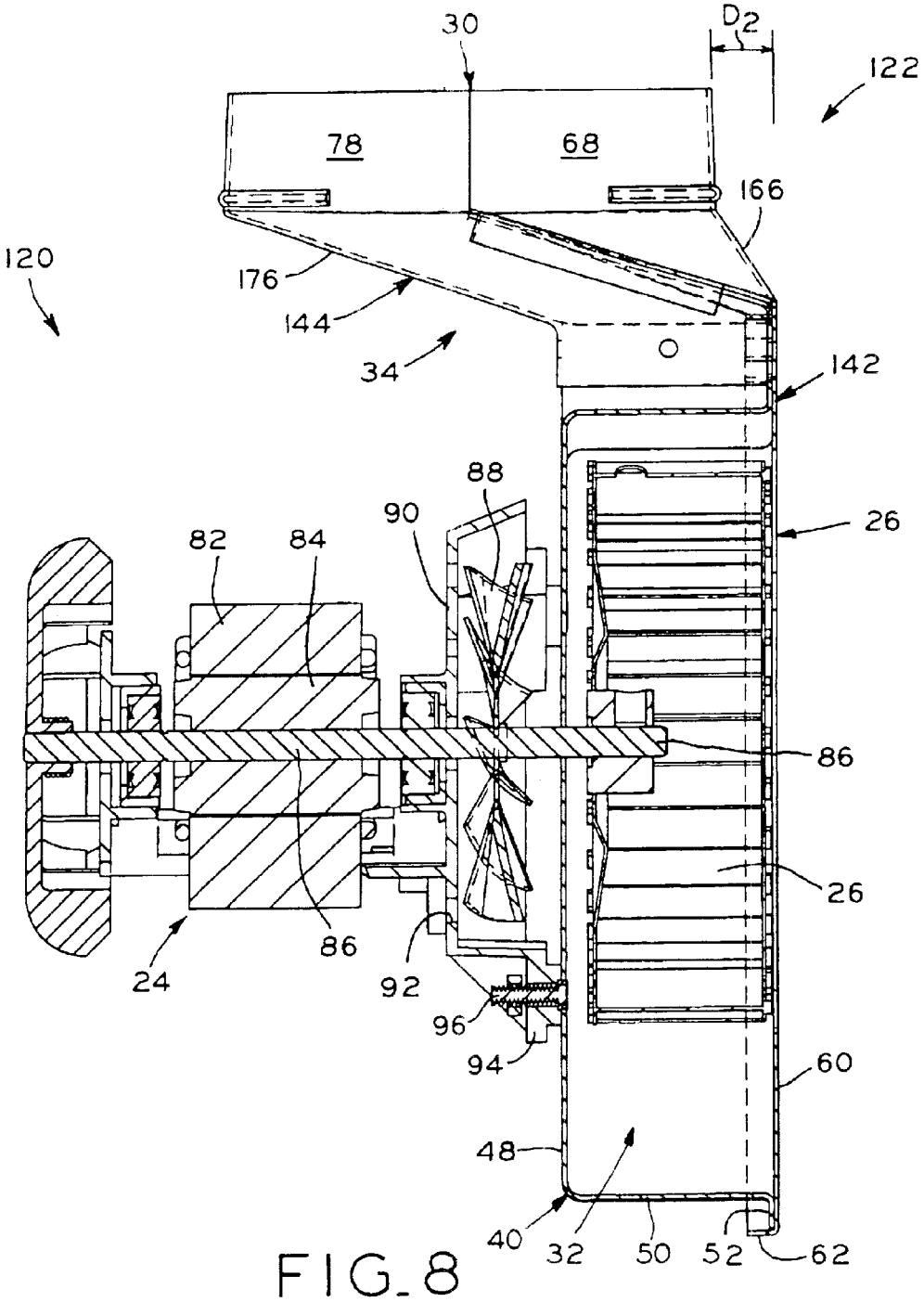
FIG. 8 is a sectional view through the blower assembly.
Figure 9:
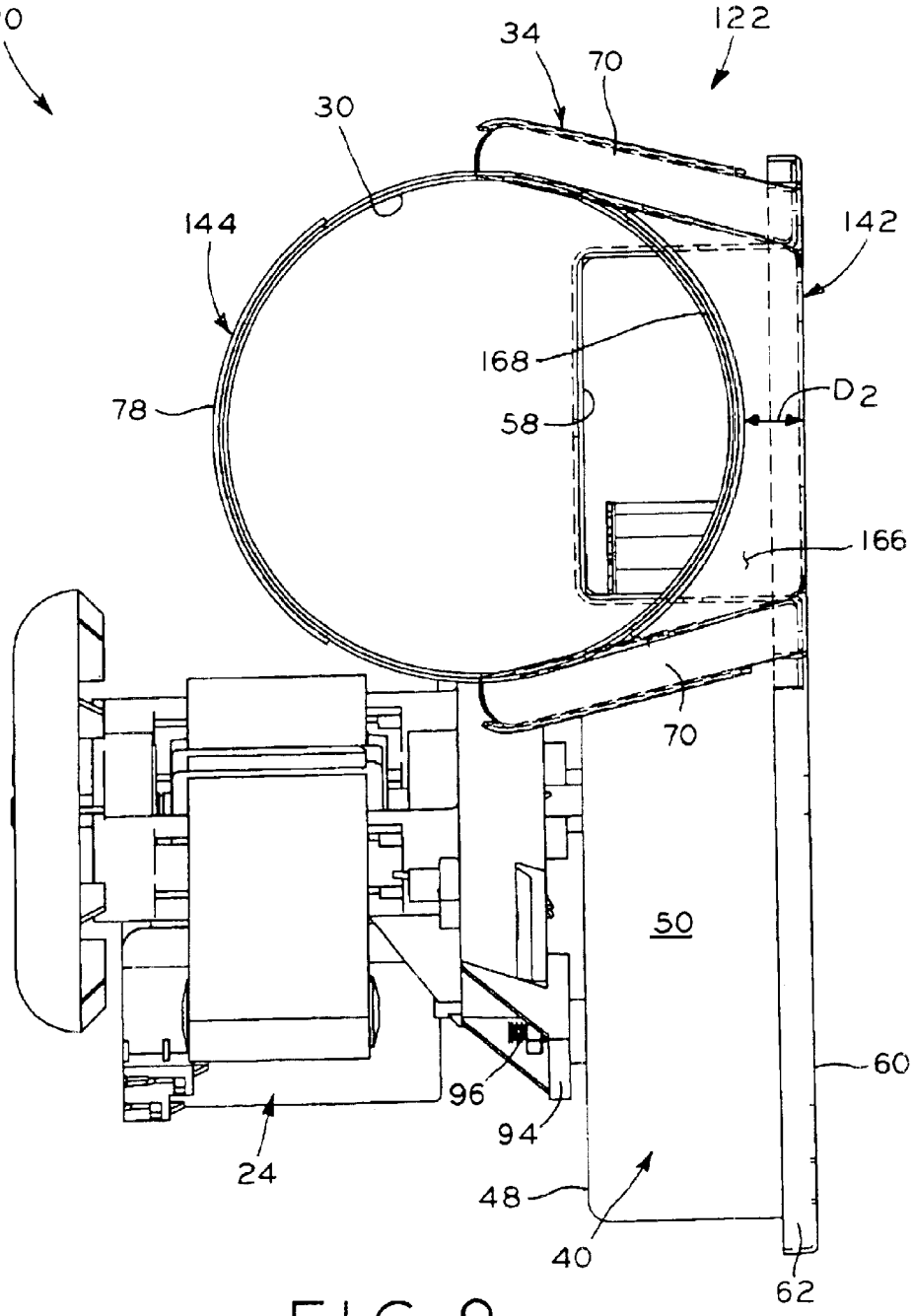
FIG. 9 is a front view of the blower assembly.

Referring to FIGS. 8 and 9, it may be seen that a second offset distance $D_2$ between wall 60 of second housing member 142 and the corresponding surface of the furnace to which blower housing 122 is mounted and the edge of blower housing outlet 30 is less than offset distance $D_1$ of the blower housing 22 of FIGS. 1–5.

Advantageously however, first housing portion 40 is a common component which is used in both first and second blower housings 22 and 122. Thus, in order to vary the offset distance for different blower housings in order to suit the needs of a particular furnace design, only the dimensions of the extension walls of the second and third housing members need be changed. Advantageously, because only the extension walls of the second and third housing members need vary between different blower housings while first housing member 40 remains the same, the overall tooling and production costs of the blower housings 22, 122 made according to the present invention are greatly reduced.

Figure 10:
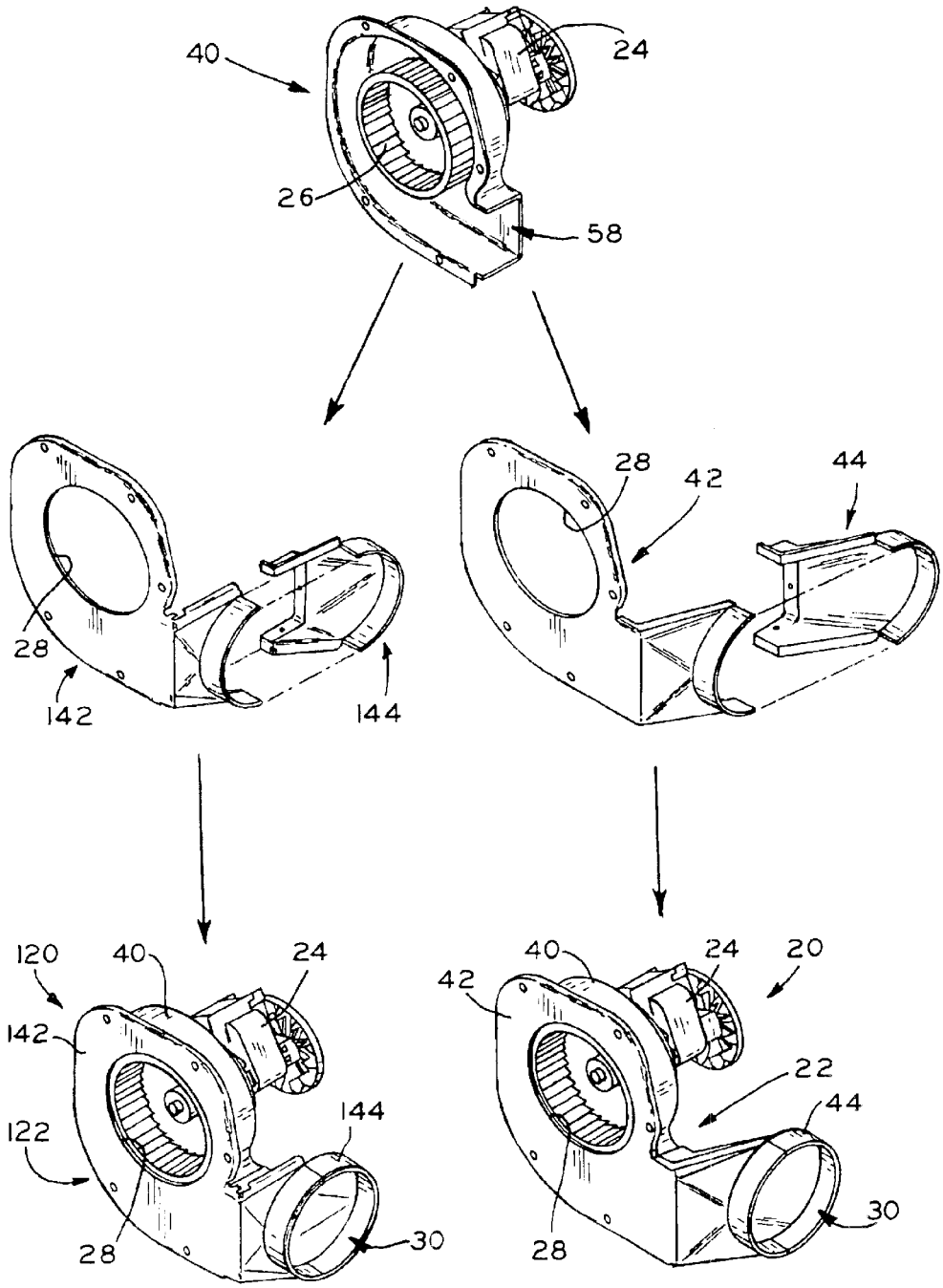
FIG. 10 is a schematic assembly view illustrating how different types of blower housings may be made according to the present invention, each type of blower housing having a common housing member.

For example, FIG. 10 shows a schematic assembly process by which different types of blower housings may be manufactured according to the present invention. Referring to the right side of FIG. 10, to form a first type of blower housing 22, such as that shown in FIGS. 1–5, first housing member 40 is used in combination with second and third housing members 42 and 44. Referring to the left side of FIG. 10, to form a second type of blower housing 122, such as that shown in FIGS. 6–9, first housing member 40 is used in combination with second and third housing members 142 and 144. Thus, the present invention provides a blower housing including three separate housing members joined to one another, in which the dimensions of a portion of two of the housing members may be varied, with one of the housing members used in common, to provide a number of different types of blower housings.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blower housing for a blower assembly of the type used for expelling gases from a furnace, the blower housing comprising:

a cavity, an inlet, and an extension portion extending from said cavity and terminating in an outlet, said blower housing formed from at least three separate housing members, comprising:

a first housing member;

a second housing member attached to said first housing member and cooperating with said first housing member to define said cavity, said second housing member including a substantially planar wall adapted for mounting said blower housing to a furnace, said inlet comprising an opening in said substantially planar wall, said second housing member further including a first extension wall; and a third housing member attached to at least one of said first and second housing members, said third housing member including a second extension wall, said first and second extension walls cooperating to define said extension portion.

2. The blower housing of claim 1, wherein said extension portion extends angularly away from said substantially planar wall, whereby said outlet is offset from said substantially planar wall.

3. The blower housing of claim 1, further comprising a cavity outlet defined at least in part by said first and second housing members, said extension portion extending from said cavity outlet to said outlet of said blower housing.

4. The blower housing of claim 3, wherein said cavity outlet has a rectangular profile with said first and second housing members cooperating with one another to define said cavity outlet.

5. The blower housing of claim 1, wherein each of said first and second housing members includes an outer flange around at least a portion of a periphery thereof, one of said flanges crimped over the other of said flanges to secure said first and second housing members together.

6. A blower housing for a blower assembly of the type used for expelling gases from a furnace, the blower housing comprising:

a cavity, an inlet, and an extension portion extending from said cavity and terminating in an outlet, said blower housing formed from at least three separate housing members, comprising:

a first housing member;

a second housing member attached to said first housing member and cooperating with said first housing member to define said cavity, said second housing member including said inlet and a first extension wall; and a third housing member attached to at least one of said first and second housing members, said third housing member including a second extension wall, said first and second extension walls cooperating to define said extension portion; and said first and second extension walls terminating in first and second outlet walls, respectively, wherein said outlet is circular, each of said first and second outlet walls curved in shape and cooperating with one another to define said outlet.

7. A blower housing for a blower assembly of the type used for expelling gases from a furnace, the blower housing comprising:

a cavity, an inlet, and an extension portion extending from said cavity and terminating in an outlet, said blower housing formed from at least three separate housing members, comprising:

a first housing member;

a second housing member attached to said first housing member and cooperating with said first housing member to define said cavity, said second housing member including said inlet and a first extension wall; and a third housing member attached to at least one of said first and second housing members, said third housing member including a second extension wall, said first and second extension walls cooperating to define said extension portion; and said first and second extension walls terminating in first and second outlet walls, respectively, wherein said outlet has a cylindrical profile, each of said first and second outlet walls shaped as a half cylinder whereby said first and second outlet walls cooperate to define said outlet.

8. A blower assembly for attachment to a furnace, comprising:

a blower housing including an impeller cavity having an inlet, and an extension portion extending from said impeller cavity and terminating in an outlet, said blower housing further comprising:

a first housing member;

a second housing member attached to said first housing member and cooperating with said first housing member to define said impeller cavity, said second housing member further including said inlet and a first extension wall having a curved end portion; and a third housing member attached to at least one of said first and second housing members, said third housing member including a second extension wall having a curved end portion, said first and second extension walls cooperating to define said extension portion and said curved end portions of said second and third housing members cooperating to define said outlet, wherein said outlet has a cylindrical profile defined by said curved end portions of said first and second extension walls;

a motor attached to said blower housing, said motor including an output shaft extending into said impeller cavity; and an impeller mounted to said motor output shaft and disposed within said impeller cavity, whereby upon rotation of said impeller by said motor, air is drawn into said inlet and is forced through said extension portion and out of said blower housing outlet.

9. The blower housing of claim 8, wherein each of said first and second housing members includes an outer flange around at least a portion of a periphery thereof, one of said flanges crimped over the other of said flanges to secure said first and second housing members together.

10. The blower housing of claim 8, further comprising a rectangular impeller cavity outlet defined by said first and second housing members, said extension portion extending from said impeller cavity outlet to said outlet of said blower housing.

11. A blower assembly for attachment to a furnace, comprising:

a blower housing including an impeller cavity having an inlet, and an extension portion extending from said impeller cavity and terminating in an outlet, said blower housing further comprising:

a first housing member;

a second housing member attached to said first housing member and cooperating with said first housing member to define said impeller cavity, said second housing member further including a substantially planar surface adapted for mounting said blower housing to a furnace, said inlet comprising an opening in said substantially planar surface, and a first extension wall having a curved end portion; and a third housing member attached to at least one of said first and second housing members, said third housing member including a second extension wall having a curved end portion, said first and second extension walls cooperating to define said extension portion and said curved end portions of said second and third housing members cooperating to define said outlet;

a motor attached to said blower housing, said motor including an output shaft extending into said impeller cavity; and an impeller mounted to said motor output shaft and disposed within said impeller cavity, whereby upon rotation of said impeller by said motor, air is drawn into said inlet and is forced through said extension portion and out of said blower housing outlet.

12. The blower housing of claim 11, wherein said extension portion extends angularly away from said substantially planar surface, whereby said outlet is offset from said substantially planar surface.

13. A method of assembling blower housings of the type used with a blower motor and impeller for expelling gases from a furnace, said method comprising the steps of:

providing a first blower housing member which is common to at least two different types of blower housings;

providing at least two second blower housing members of different types;

selecting one of the second blower housing members;

providing at least two third blower housing members of different types;

selecting one of the third blower housing members;

attaching the first blower housing member, the selected second blower housing member, and the selected third blower housing member to one another to form a blower housing of a first type.

14. The method of claim 13, including the further steps of:

providing another first blower housing member;

selecting another type of each of the second and third blower housing members; and attaching the foregoing first, second, and third blower housing members to one another to form a blower housing of a second type.

15. The method of claim 13, wherein each type of blower housing includes an impeller cavity having an inlet, and a extension portion extending from the impeller cavity and terminating in an outlet.

16. The method of claim 15, wherein in each type of blower housing, the first and second blower housing members cooperate to define the impeller cavity, and the second and third blower housing members cooperate to define the extension portion and the outlet.

17. The method of claim 15, wherein each of the second blower housing members and each of the third blower housing members includes an extension wall, the extension walls of respective second and third blower housing members cooperating to define the extension portion of each blower housing, the different types of second and third blower housing members having extension walls of different dimensions.

18. The method of claim 15, wherein each of the second blower housing members and each of the third blower housing members includes an outlet wall, the outlet walls of respective second and third blower housing members cooperating to define the blower housing outlet of each blower housing.

19. The method of claim 18, wherein the outlet walls of each of the second and third blower housing members is curved in shape, whereby the outlet walls of respective second and third blower housing members cooperate to define a circular blower housing outlet.

20. A blower housing, comprising:

a first housing member;

a second housing member attached to said first housing member and cooperating with said first housing member to define a cavity, said second housing member further including a base wall having an inlet opening, and a first extension portion extending angularly away from said base wall; and a third housing member attached to at least one of said first and second housing members, said third housing member including a second extension portion cooperating with said first extension portion to define an outlet opening.

21. The blower housing of claim 20, wherein said outlet opening is circular, each of said first and second outlet portions including curved sections cooperating with one another to define said outlet opening.

22. A blower housing, comprising:

a first housing member;

a second housing member attached to said first housing member and cooperating with said first housing member to define a cavity, said second housing member including a first extension portion with a curved end; and a third housing member attached to at least one of said first and second housing members, said third housing member including a second extension portion with a curved end, said first and second extension portions cooperating with one another to define an exhaust transition having a circular outlet opening defined by said curved ends.

23. The blower housing of claim 22, wherein said second housing member includes a substantially planar base wall with an inlet opening therein, said first extension portion extending angularly away from said base wall.

* * * * *